United States Patent [19]

Fecske

[11] 4,372,845

[45] Feb. 8, 1983

[54] MULTIPLE HYDROCYCLONE SEPARATOR

[75] Inventor: Aurel J. Fecske, Huddinge, Sweden

[73] Assignee: Alfa-Laval AB, Tumba, Sweden

[21] Appl. No.: 153,915

[22] Filed: May 28, 1980

[30] Foreign Application Priority Data

Jun. 1, 1979 [SE] Sweden ..... 7904830

[51] Int. Cl.[3] ..... B04C 5/28

[52] U.S. Cl. ..... 209/211; 210/512.2

[58] Field of Search ..... 209/211, 144; 210/512 M; 55/349

[56] References Cited

U.S. PATENT DOCUMENTS

| | | | |
|---|---|---|---|
| 3,959,123 | 5/1976 | Wikdahl | 209/211 |
| 4,148,721 | 4/1979 | Brown et al. | 209/211 |
| 4,189,377 | 2/1980 | Dahlberg et al. | 209/211 |

*Primary Examiner*—Ralph J. Hill

*Attorney, Agent, or Firm*—Cyrus S. Hapgood

[57] ABSTRACT

A multiple hydrocyclone assembly comprises a housing, a plurality of groups of radially extending cyclones provided at different levels in said housing, and inlet and outlet conduits connected to the bottom portion of the assembly. In order to avoid collection of air in the housing the outlet conduit comprises a central tube extending vertically through the housing to the top portion thereof.

6 Claims, 1 Drawing Figure

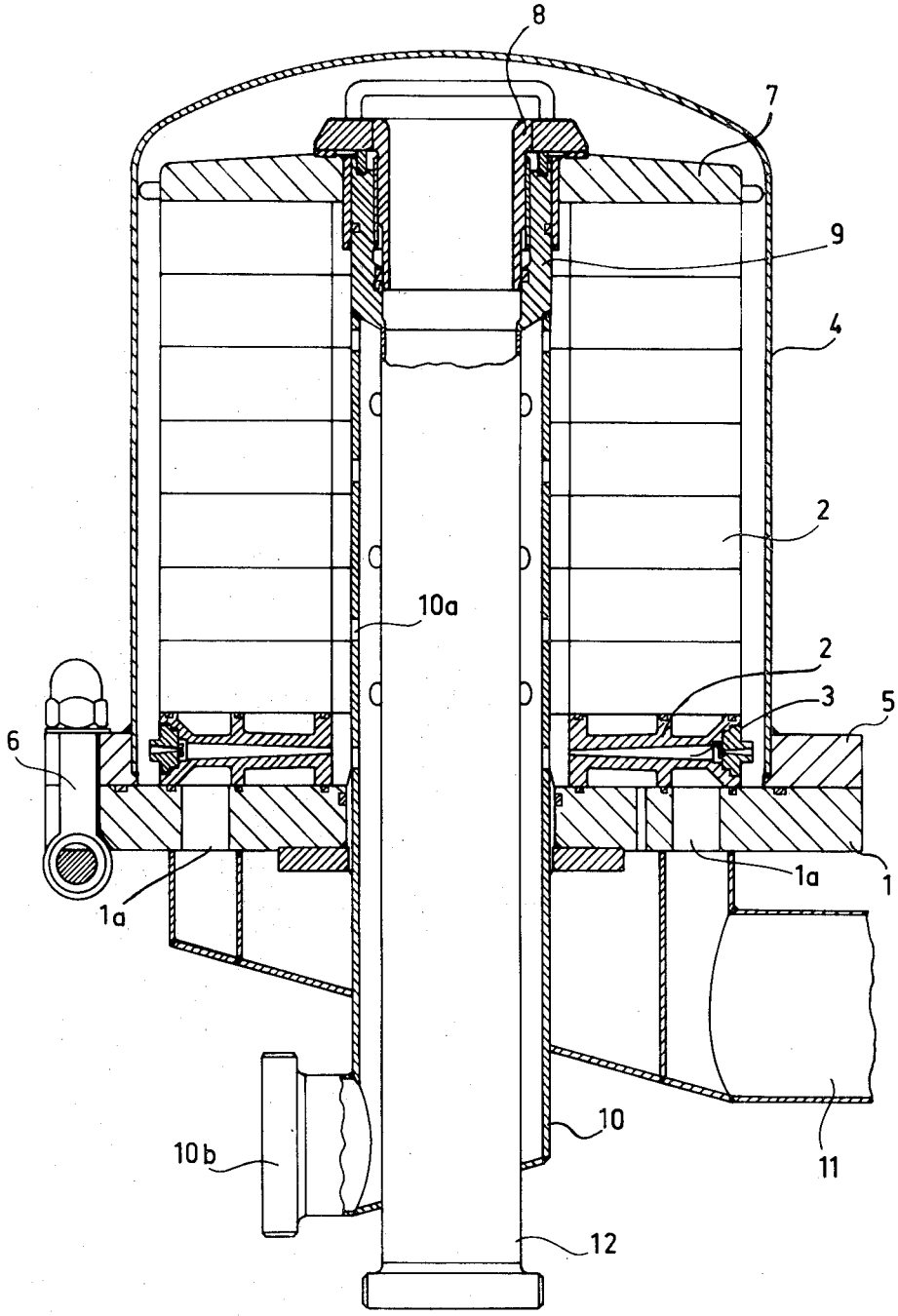
8
7
9
4
2
10a
2
3
5
6
1a
1a
1
10
10b
11
12

MULTIPLE HYDROCYCLONE SEPARATOR

The present invention relates to a multiple hydrocyclone separator assembly of the type comprising a housing, a plurality of groups of radially extending cyclones provided in said housing at different levels, and inlet and outlet conduits connected to the bottom portion of the assembly.

One reason for connecting the inlet and outlet conduits to the lower portion of the separator housing is that this arrangement simplifies the construction. Also, it facilitates servicing of the apparatus by making it possible to open the housing and disassemble the cyclones without needing to release the pipelines.

However, a drawback of this previously known construction is that air bubbles accompanying the suspension feed tend to collect in the top portion of the housing, which may affect the operation of the apparatus. To make the apparatus operate in the best manner, it is necessary that all the cyclones be below the liquid level; and if air is allowed to collect in the top portion of the housing, the liquid level will gradually sink below the uppermost cyclones.

A known solution to this problem is to provide a venting valve at the top portion of the housing. To avoid collection of air in the housing, the valve must be opened at regular intervals to evacuate the air. Thus, such an apparatus requires regular attention in order to avoid failures in operation. It is also known to evacuate the air by means of a separate vacuum system.

The principal object of the invention is to provide a multiple hydrocyclone separator in which the risk of air collection is eliminated without using any air venting valve or vacuum system. This has been achieved by means of a multiple hydrocyclone separator of the type previously mentioned which is characterized in that the outlet conduit for one of the separated fractions, preferably the lighter one, forms a central, tubular passage extending vertically through the housing to the top portion thereof, and the outlet conduit for the other separated fraction forms an annular passage surrounding said tubular passage and extending coaxially therewith.

The invention will be described in more detail below with reference to the accompanying drawing, in which the single illustration is a vertical sectional view, partly in elevation, of a preferred embodiment of the cyclone separator according to the invention.

The cyclone separator as illustrated comprises a base 1 on which a number of molded cyclone plates 2 are stacked on top of each other. Each of the cyclone plates 2 comprises a plurality of circumferentially spaced, radially extending hydrocyclones 3. For the sake of simplicity, the hydrocyclones have been shown sectionally in only the bottom cyclone plate 2. The stack of cyclone plates is enclosed in a housing 4 with a rim 5 which is attached to the base 1 by means of a plurality of circumferentially spaced bolts 6. The cyclone plates 2 are clamped together by means of a pressure plate 7 and a tubular screw 8 which has threaded engagement with the interior of a sleeve 9. The latter is connected to a tube 10 which extends axially through the apparatus and is attached to the base 1. The tube 10 thus operates as a tension rod when clamping the cyclone plates 2 between the base 1 and the pressure plate 7.

The suspension to be treated in the apparatus is supplied through inlet tube means 11 and flows through a plurality of openings 1*a* in the base 1 to each of the cyclones 3. To this end, the cyclone plates are provided with axial through-flow openings (not shown) which allow the suspension to flow upwards through the stack of cyclone plates.

An example of details of a suitable arrangement of the cyclone plates and the inlet passages to the individual cyclones is disclosed in U.S. Pat. No. 4,189,377 issued Feb. 19, 1980, to Dahlberg et al.

The lighter of the two separated fractions escapes radially outwards from the cyclones 3 and flows upwards in the space between the cyclone plates 2 and the housing 4 and further through a central outlet tube 12 which is provided within the tube 10 and is coaxial therewith. The second, heavier fraction flows through perforations 10*a* in the tube 10 and then downwards in the annular space between the tubes 10 and 12 to the outlet 10*b*. If desired, the cyclones could be turned in the opposite direction so that the heavier separated fraction discharges through the central tube 12 and the lighter fraction through the annular space surrounding tube 12.

As is apparent from the drawing, the inner tube 12 is connected to the sleeve 9 and the tubular screw 8. These elements thus form an outlet passage the upper end of which is situated close to the top portion of the housing 4. Due to the fact that the flow velocity is relatively high in this passage, collection of air in the top portion of the housing is effectively prevented. This is becase the air bubbles, if any, will be automatically entrained with the flow escaping through the tube 12, due to the high flow velocity.

It is also within the scope of the invention to use separate hydrocyclones mounted in brackets in a conventional manner, instead of the molded cyclone plates 2.

I claim:

1. In a multiple hydrocyclone separator assembly, the combination of a housing having a generally vertical axis, a plurality of groups of cyclones mounted in the housing at different levels, inlet tube means connected directly to the bottom portion of the assembly for supplying a suspension to the cyclones, each cyclone extending radially from said axis and having at one end an outlet near said axis for discharging a first separated faction of the suspension and at the opposite end an outlet remote from said axis for discharging a second separated fraction of the suspension, and conduit means forming a tubular passage disposed centrally of the housing and extending vertically from said bottom portion of the assembly to a region in the top portion of the housing located above said cyclone groups, said central tubular passage forming an outlet path for said second fraction, the conduit means also forming an annular passage immediately surrounding said central passage and extending coaxially therewith, said annular passage forming an outlet path for said first fraction.

2. The combination of claim 1, in which said second fraction is the lighter of the two separated fractions.

3. The combination of claim 1, in which the housing contains an annular space through which said second fraction is adapted to flow upwardly into said top region of the housing, the second fraction then flowing downwardly through said central passage.

4. The combination of claim 1, in which said groups of cyclones surround said conduit means.

5. The combination of claim 1, in which said conduit means include inner and outer concentric conduits, the outer conduit being connected to said bottom portion of the assembly, the combination comprising also a pressure plate overlying said groups of cyclones, said conduit means including a member having a threaded connection with the upper portion of said outer conduit and operable on the pressure plate to clamp said groups together.

6. The combination of claim 1, comprising also a pressure plate overlying said groups of cyclones, said conduit means including inner and outer concentric conduits, the outer conduit being connected at its lower portion to said bottom portion of the assembly and having at its upper portion a sleeve, said inner conduit including a main section connected at its upper portion to said sleeve, the inner conduit also including a rotatable hollow member having a threaded connection with said sleeve and operable on the pressure plate to clamp said groups together, said hollow member forming the upper portion of said central tubular passage.

* * * * *